US005570478A

United States Patent [19]

Armstrong

[11] Patent Number: 5,570,478

[45] Date of Patent: Nov. 5, 1996

[54] TOILET SEAT HINGE ASSEMBLY FOR AUTOMATICALLY LOWERING SEAT AFTER FLUSHING

[76] Inventor: Carmon A. Armstrong, 304 Meadow Ridge, Fulton, Mo. 65251-2916

[21] Appl. No.: 369,094

[22] Filed: Jan. 5, 1995

[51] Int. Cl.[6] ..... A47K 13/10

[52] U.S. Cl. ..... 4/246.1

[58] Field of Search ..... 4/246.1–246.3, 4/406

[56] References Cited

U.S. PATENT DOCUMENTS

| | | | |
|---|---|---|---|
| 4,491,989 | 1/1985 | McGrail | 4/246.1 |
| 5,222,260 | 6/1993 | Piper | 4/246.1 |
| 5,307,524 | 5/1994 | Veal | 4/246.1 |

*Primary Examiner*—Charles E. Phillips

[57] ABSTRACT

A hinge assembly for installation on a toilet to mount a toilet seat on a toilet for pivotal movement between an up position and a down position, and to automatically move the seat from the up position to the down position after the toilet is flushed. The assembly includes a shaft mounted for rotation about its axis between an up position and a down position. A hinge member for attachment to the toilet seat is mounted on the shaft so that when seat and the shaft are in their down positions, movement of the seat to the up position rotates the shaft to its up position, and when the seat and the shaft are in their up positions, rotation of the shaft to the down position pivots the seat to its down position. A spring resiliently biases the shaft to rotate from its up position to its down position. The assembly also includes a flush detector for detecting when the toilet is flushed, and a lock for locking the shaft against rotation, but which releases the shaft after the flush detector detects that the toilet has been flushed. A second spring may be provided to biases the toilet seat upwardly to slow the movement of the seat from the up position to the down position.

13 Claims, 4 Drawing Sheets

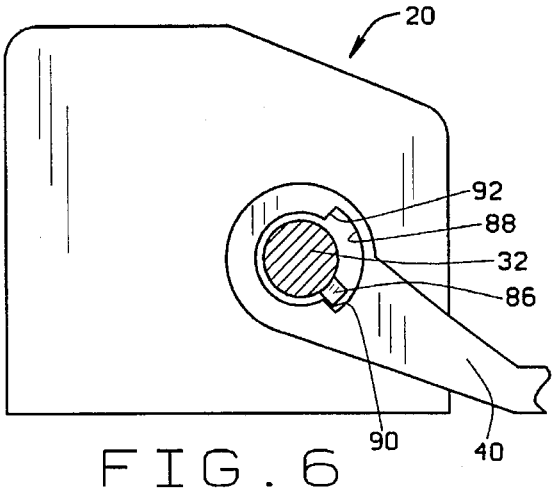
FIG. 6
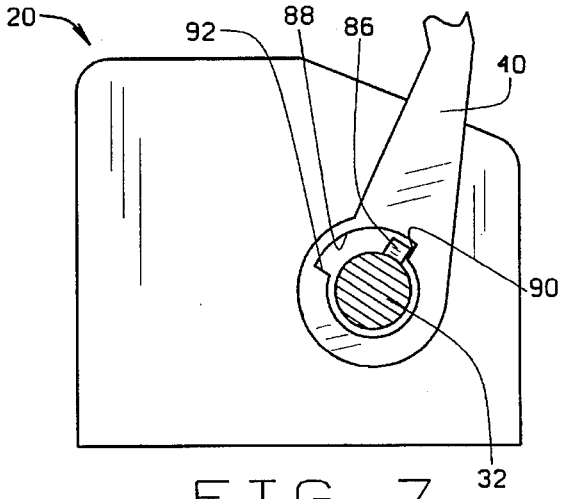
FIG. 7
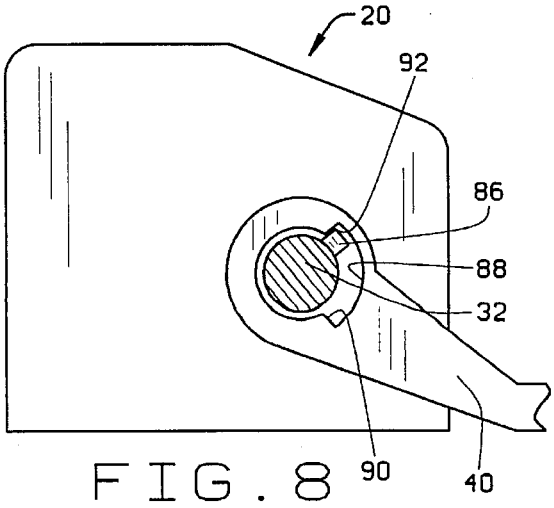
FIG. 8
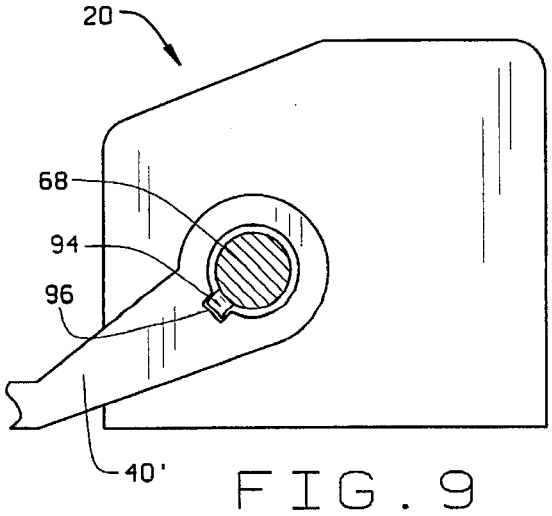
FIG. 9
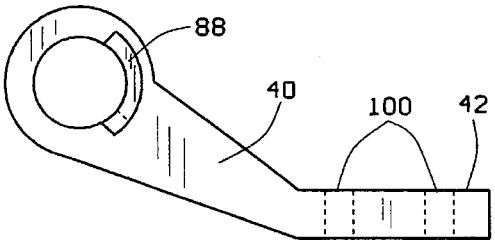
FIG. 10
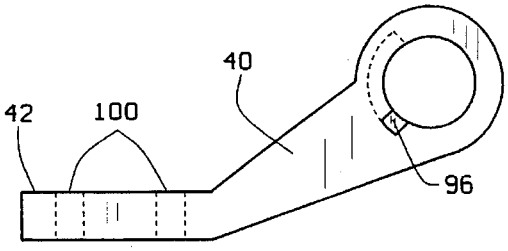
FIG. 11
FIG. 12
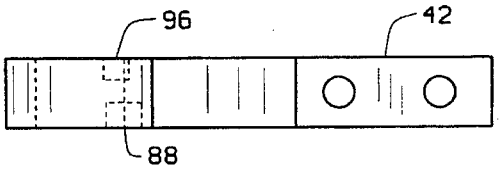

TOILET SEAT HINGE ASSEMBLY FOR AUTOMATICALLY LOWERING SEAT AFTER FLUSHING

BACKGROUND AND SUMMARY OF THE INVENTION

This invention relates to a toilet seat hinge assembly for mounting a toilet seat on a toilet for pivotal movement between an up position and a down position, and in particular to a toilet seat hinge assembly that automatically moves the seat from the up position to the down position after the toilet is flushed.

It is well known that after raising a toilet seat to use the toilet, many men fail to return the toilet seat to its down position. This is unsightly, and can be an inconvenience to subsequent users. The present invention provides a hinge assembly that is adapted to pivotally mount a toilet seat for pivotal movement between an up position and a down position, and which also automatically lowers the seat from its up position after detecting that the toilet has been flushed.

The toilet seat hinge assembly of this invention is adapted to replace the conventional hinge on a toilet to mount a toilet seat on a toilet for pivotal movement between an up position and a down position. Generally, the toilet seat hinge assembly of this invention comprises at least one hinge member for attachment to the seat, and pivotally mounted so that the seat can pivot between an up position and a down position. A spring resiliently biasing the seat to its down position. A lock releasably holds the seat in its up position against the bias of the spring. A flush detector detects when the toilet is flushed, and releases the lock, thereby allowing the spring to bias the toilet seat to its down position. Preferably, a second spring which resiliently biases the toilet seat upwardly with less force than the spring that resiliently biases the shaft to rotate from the up position to the down position, to slow the movement of the seat from the up position to the down position. The hinge assembly is particularly adaptable for the conventional tank type toilets found in most residences. In this case, the flush detector can comprise a sensor for sensing the drop in the water level in the tank that occurs when the toilet is flushed. In the preferred embodiment of the invention, the lock is a solenoid having a plunger biased to engage the seat against rotation when it is in the up position, which when energized disengages the seat to permit the seat to rotate under the bias of the spring to its down position.

The hinge assembly of the present invention is thus of simple, an relatively inexpensive construction. It can be easily retrofit on existing toilets. It uses a minimum of power relying upon a spring for the motive force to move the toilet seat downwardly, and only energizing the solenoid lock briefly to release the seat when toilet has been flushed. A second spring counteracts the force of the first spring to prevent slamming of the toilet seat.

These and other features and advantages will be in part apparent, and in part pointed out hereinafter.

BRIEF DESCRIPTION OF THE DRAWINGS

FIG. 6 is a partial cross sectional view of the hinge assembly taken along the plane of line 6—6 in FIG. 3, with the toilet seat hinge shown in the down position;

FIG. 7 is a partial cross sectional view of the hinge assembly taken along the plane of line 7—7 in FIG. 4, with the toilet seat hinge shown in the up position;

FIG. 8 is a partial cross sectional view of the hinge assembly taken along the plane of line 7—7 in FIG. 4, with the toilet seat hinge shown in the down position;

FIG. 9 is a partial cross sectional view of the hinge assembly taken along the plane of line 9—9 in FIG. 3;

FIG. 10 is a left side elevation view of the hinge member;

FIG. 11 is a right side elevation view of the hinge member;

FIG. 12 is a top plan view of the hinge member;

Corresponding reference numerals indicate corresponding parts throughout the several views of the drawings.

DETAILED DESCRIPTION OF THE PREFERRED EMBODIMENT

Figure 1:
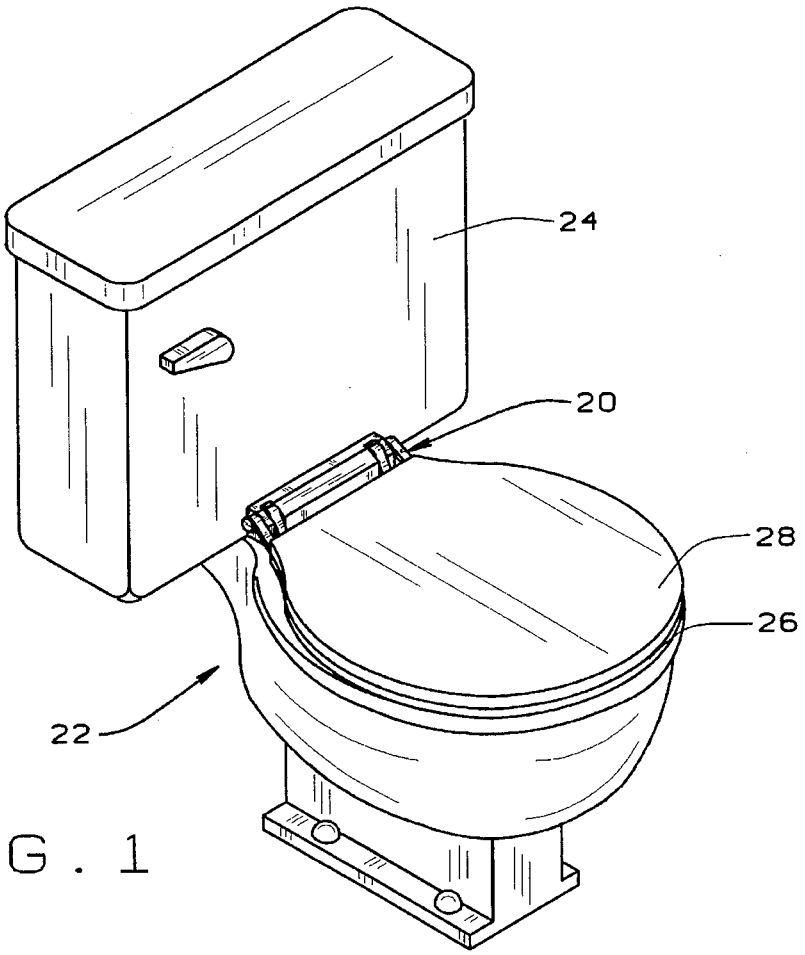
FIG. 1 is a perspective view of a toilet incorporating the hinge assembly of this invention.
Figure 2:
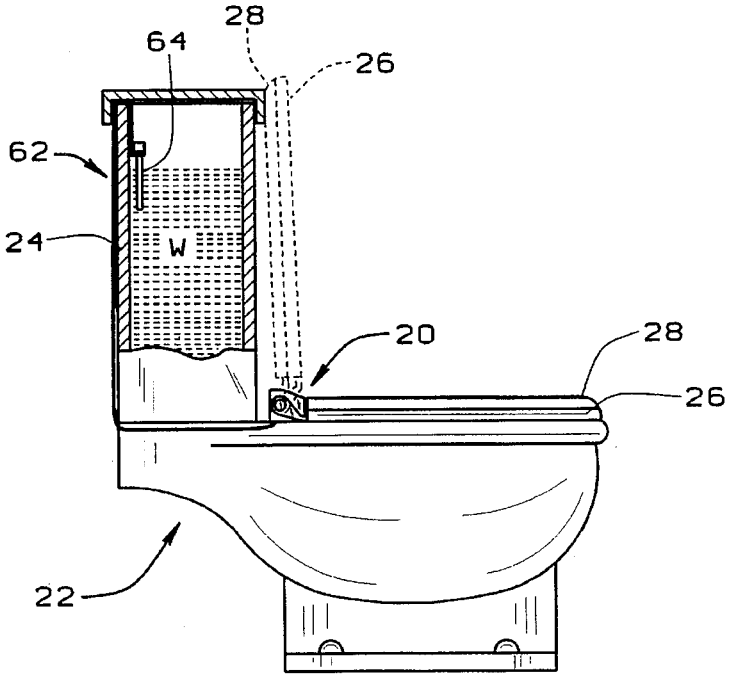
FIG. 2 is a side elevation view of the toilet incorporating the hinge assembly of this invention.

A hinge assembly 20 constructed according to the principles of this invention is shown in FIG. 1 as it would be installed on a conventional toilet 22, having a tank 24. The hinge assembly 20 mounts a toilet seat 26 for pivotal movement between an up position (as shown in phantom in FIG. 2) and a down position (as shown in FIG. 1), as does a conventional toilet seat hinge. However, the hinge assembly 20 can also automatically move the seat 26 from the up position to the down position after the toilet 22 is flushed. The hinge assembly may also mount a lid 28 for pivotal movement between an up position (as shown in phantom in FIG. 2) and a down position (as shown in FIG. 1), as does a conventional toilet seat hinge.

Figure 3:
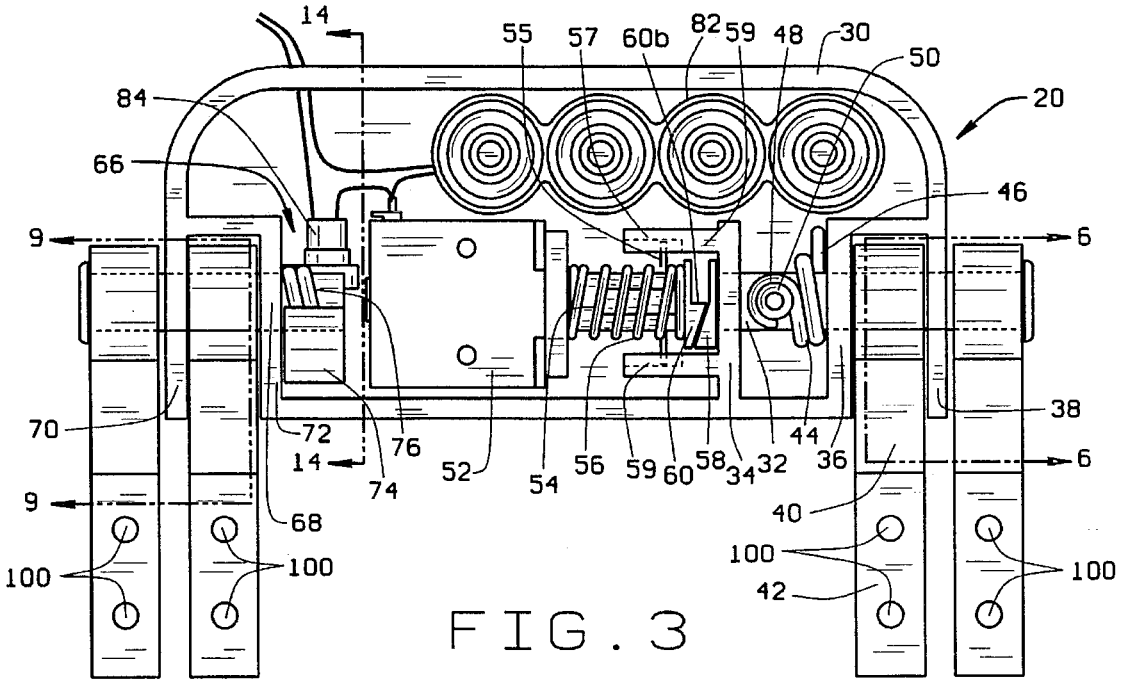
FIG. 3 is a top plan view of the hinge assembly, shown as it would appear when the toilet seat is down.

The hinge assembly 20 comprises a housing 30 for enclosing and protecting the mechanism of the hinge assembly. A shaft 32 is mounted in the housing 30 for rotation about its axis between an up position (FIGS. 4 and 5), and a down position (FIG. 3). As shown in FIGS. 2–5, the shaft 32 is mounted through three vertical walls 34, 36, and 38 which form a part of the housing 30. A hinge member 40, having an extension 42 adapted for attachment to the toilet seat 26, is mounted on the shaft 32 so that when seat and the shaft are in their down positions, movement of the seat to the up position rotates the shaft to its up position, and when the seat and the shaft are in their up positions, rotation of the shaft to the down position pivots the seat to its down position, as described more fully below.

Figure 4:
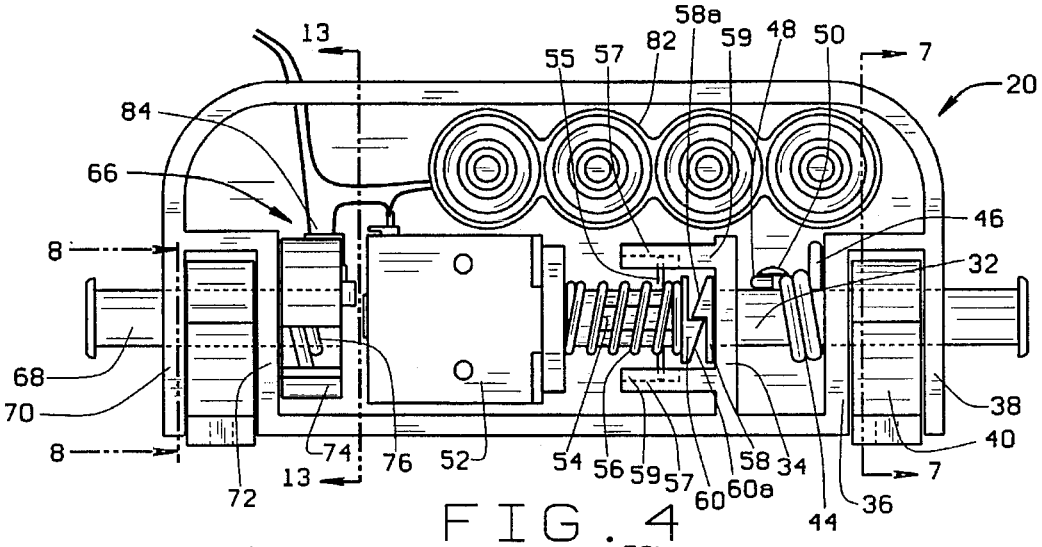
FIG. 4 is a top plan view of the hinge assembly, shown as it would appear when the toilet seat is up, and the lock is engaged.
Figure 5:
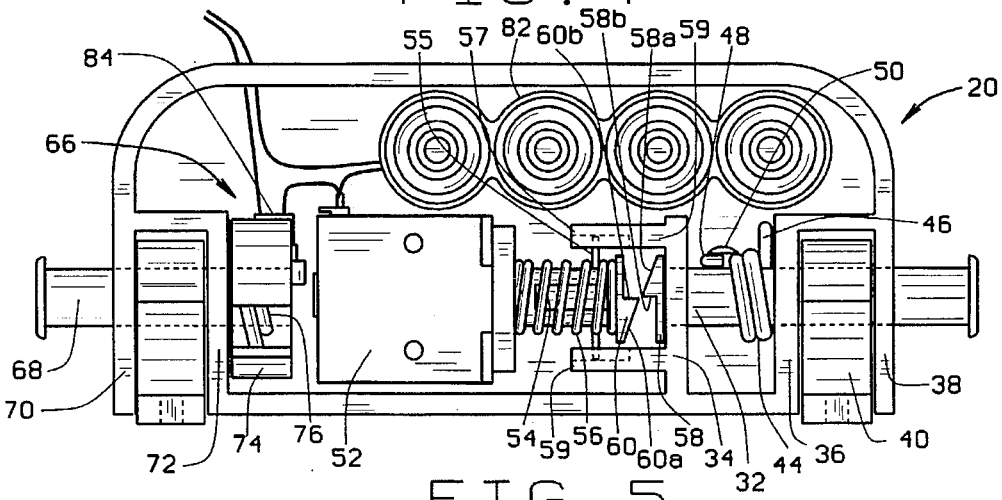
FIG. 5 is a top plan view of the hinge assembly, shown as it would appear when the toilet seat is up, and the lock is disengaged.

The hinge assembly 20 further comprises a spring 44 that resiliently biases the shaft 32 to rotate from the up position to the down position. As shown in FIGS. 3–5, the spring 44 can be a coil spring, coiled around the shaft 32. One end of the coil spring may have a leg 46 adapted to engage the housing 30, and the other end of the coil spring may have an eye 48 so that the spring can be engaged to the shaft, for example with a rivet 50. Of course any other type of spring or other mechanism could be used to bias the shaft 32.

The hinge assembly 20 preferably also includes a solenoid 52 having a plunger 54 which is biased with a spring 56 to engage the shaft 32 against rotation when the shaft is in its up position, but which, when the solenoid is energized, disengages the shaft to permit the shaft to rotate under the bias of the spring 44 to its down position. The plunger 54 preferably has a guide pin 55 extending transversely therethrough. The ends of the guide pin 55 travel in slots 57 in walls 59 surrounding the plunger, to guide the travel of the plunger 54, The end of the shaft 32 and of the plunger 54 have mating locking members 58 and 60, respectively. The locking members 58 and 60 also have beveled faces **58*a* and 60*a*, respectively, so that as the shaft 32 turns from its down position to its up position, the locking member 58 cams the plunger 54 out of the way. The locking members 58 and 60 also have locking faces 58*b* and 60*b* which engage when the shaft 32 is in its up position (see FIG. 4), so that the plunger 54** holds the shaft against rotation.

The hinge assembly 20 also includes a flush detector 62 for detecting when the toilet is flushed, and energizing the solenoid when a flush is detected. In this preferred embodiment the flush detector comprises a water level sensor 64 that can be mounted in the tank 24 to sense the drop in the water level in the tank accompanying the flushing of the toilet.

Figure 13:
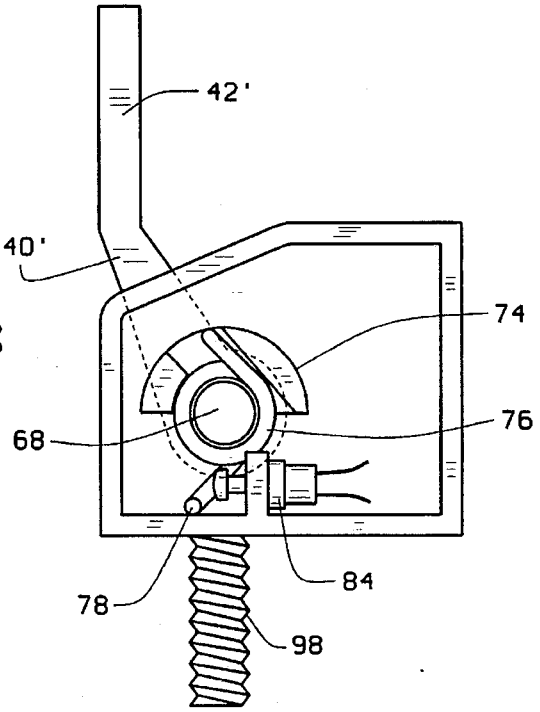
FIG. 13 is a partial cross sectional view of the seat assembly taken along the plane of line 13—13 in FIG. 4.
Figure 14:
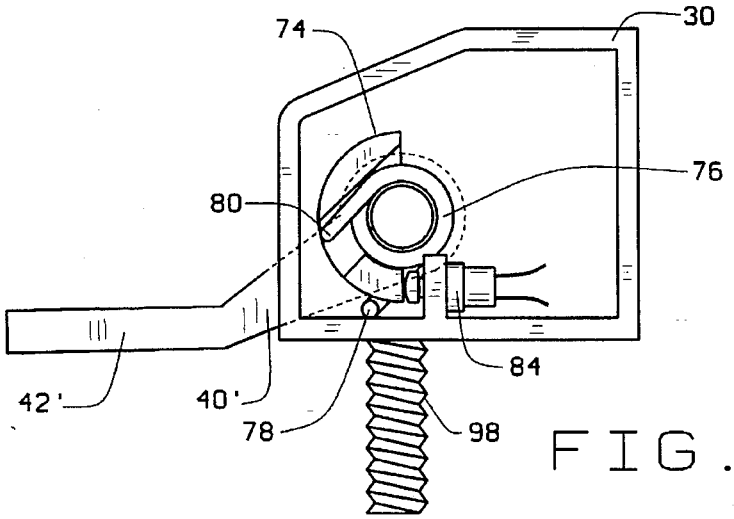
FIG. 14 is a partial cross sectional view of the seat assembly taken along the plane of line 14—14 in FIG. 3.

The hinge assembly preferably also includes a load reduction assembly 66 that biases the seat upwardly, to partially counter act the force of the spring 44 and the weight of the seat 26, to reduce banging as the seat moves from its up position to its down position. In this preferred embodiment the load reduction assembly comprises a shaft 68 mounted in the housing for rotation about its axis between an up position, and a down position. As shown in FIGS. 2–5, the shaft 68 is mounted through two vertical walls 70 and 72 that form a part of the housing 30. A hinge member 40', having an extension 42' adapted for attachment to the toilet seat 26, is mounted on the shaft 68 so that seat and the shaft move together between their respective up and down positions. A cage 74 is mounted on the shaft 68 for rotation with the shaft. A spring 76 is mounted on the shaft 68, inside the cage 74. As best shown in FIGS. 13 and 14, the spring 76 has a first foot 78 that engages the bottom of housing, and a second foot 80 that engages the cage 74 to resiliently bias the shaft 68 and thus the seat 24 to its up position, in opposition to the force of the spring 44 and the weight of the seat.

Figure 15:
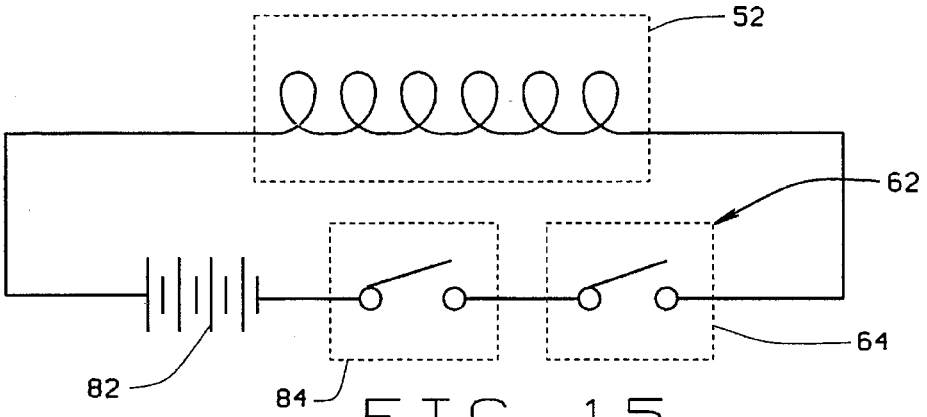
FIG. 15 is a schematic diagram of the electric circuit embodied in the hinge assembly.

The hinge assembly 20 further comprises a series of batteries 82 for providing electric power to the sensor 64 and to the solenoid 52. The hinge assembly 20 preferably also includes a power saving switch 84 that turns off power to the sensor 64 when the seat 24 is down. In this preferred embodiment, this power saving switch comprises a normally closed push button switch 84. (See FIGS. 13 and 14.) When the push button switch 84 is in its normal position as shown in FIG. 13 (corresponding to when the seat is up) power is provided to the sensor 64 through the normally closed push button switch. When the push button is depressed as shown in FIG. 14 (corresponding to when the seat is down), power is cut off from the sensor 64. Thus the switch 84 ensures that power is only used when the seat is up, i.e., when there is a need to automatically lower the seat. The push button switch 84 is preferably operated by the cage 74, which turns with the shaft 66 and seat to depress the push button when the seat is in its down position. The wiring of the hinge assembly 20 is shown schematically in FIG. 15.

In this preferred embodiment, the shaft 32 preferably has a key 86 projecting radially therefrom, and the hinge member 40 has an arcuate slot 88 for receiving the key 86 and allowing limited relative rotation between the hinge member and the shaft. As explained below, this allows the seat 26 to be manually lowered from its up position even when the shaft 32 remains locked in its up position. The slot 88 has first and second ends 90 and 92, respectively, for engaging the key 86. The key 86 engages the first end 90 of the slot 88 when the seat 26 and the shaft 32 are in their down positions, so that movement of the seat from the down position to the up position rotates the shaft. The key 86 remains in engagement with the first end 90 of the slot 88 when the seat 26 and shaft 32 are in their up positions, so that rotation of the shaft from its up position to its down position causes the seat to pivot to its down position. However, because the key 86 can freely move in the slot, the hinge member 40 can turn relative to the shaft so that the seat 26 can be lowered manually, without actuation of the hinge assembly 20, if desired. This allows the seat to be lowered, for example, in the event battery 82 fails.

Also in this preferred embodiment the shaft 68 preferably has a key 94 projecting radially therefrom, and the hinge member 40' has a notched keyway 96 into which the key 94 fits so that the hinge member 40' and shaft 68 rotate together.

For convenience and economy of manufacture, the hinge members 40 and 40' can be identical, as shown in FIGS. 10–12. One side of these hinge members has the arcuate slot 88 therein, and the other side of the hinge member has keyway 96.

As noted above, a toilet lid 28 can be pivotally mounted on the outside ends of the shafts 32 and 68, for manual movement between an up position (shown in phantom in FIG. 2) and a down position (shown in FIG. 1).

OPERATION

In operation, a hinge assembly 20 constructed according to the principles of this invention is installed on a toilet 22. There are threaded studs 98 depending from the housing 30 for securing the hinge assembly on the toilet, for example, with nuts (not shown). The extension 42 and 42' of the hinge members 40 and 40' having mounting holes 100 for attachment to a seat 26. An additional pair of hinge members 40 and 42 can be provided on the outside ends of the shafts 32 and 68 for mounting a lid 28. Like the seat 26, the lid is mounted on the extensions 42 and 42' of the hinge members 40 and 40'

When the seat 26 and shafts 32 and 68 are in their respective down positions (see FIGS. 3 and 6), the seat can simply be pivoted to its up position. The movement of the seat 26 causes the shaft 32 to rotate by virtue of the contact between end 90 of slot 88 on hinge member 40, and the key 86 on the shaft. As the shaft 32 turns, the beveled surface **58*a* on locking member 58, acts on beveled surface 60*a* on locking member 60 on plunger 54, cramming the plunger against the bias of spring 56. The shaft turns until the locking faces 58*b* and 60*b* engage, as shown in FIG. 4. As the shaft 32 turns, spring 44 is wound, creating a force tending to rotate the shaft to its down position. The plunger 54 holds the shaft 32** against further rotation.

The movement of seat 26 also causes the shaft 68 to rotate by virtue of the contact between keyway 96 on hinge member 40' and key 94 on shaft 68. The cage 74 rotates with shaft 68, releasing the push button 84 as the seat reaches its up position, providing power from batteries 82 to detector 62, for example sensor 64.

The sensor 64 monitors the level of water in the tank 24, detecting the drop in level that occurs when the toilet is flushed. Of course, some alternative sensor for detecting when the toilet is flushed could be used.

While the seat 26 is up, it can be manually moved to the down position, the slot 88 accommodating the key 86 and permitting relative movement between the hinge member 40 and the shaft 32. Compare FIGS. 7 and 8.

While the seat 26 is in its up position, the detector 62 is provided with power to detect the flushing of the toilet 22. When a flush is detected, the detector 62 closes the circuit between the batteries 82 and the solenoid 52, actuating the plunger 54 to retract against the bias of spring 56, disengaging the shaft 32 (FIG. 5). The spring 44 then urges shaft 32 to turn, and the key 86 on the shaft acting against the first end 90 of the slot 88, causes the hinge member 40 to move the seat to its down position.

The spring 44 need only move the seat past vertical center, after which the weight of the seat will generally cause the seat to fall to its down position.

As the seat moves to its down position, it turns shaft 68 to turn the keyway 98 on the hinge member 40' engages the key 96 on the shaft. The turning of the shaft 68 turns the cage 74, causing the spring 76 to wind, creating an increasing force as the seat moves to its down position opposing the movement of the seat, thereby slowing the seat somewhat so that it does not "bang." The force of the spring is not so great that it prevents the seat from reaching its down position. As the cage 74 turns, the push button switch is depressed, opening the circuit and preserving battery power.

The hinge assembly is ready for use again.

What is claimed is:

1. A hinge assembly for installation on a toilet to mount a toilet seat on a toilet for pivotal movement between an up position and a down position, and to automatically move the seat from the up position to the down position after the toilet is flushed, the assembly comprising:

a shaft mounted for rotation about its axis between an up position, and a down position;

a hinge member for attachment to the toilet seat, mounted on the shaft so that when the seat and the shaft are in their respective down positions, movement of the seat to the up position rotates the shaft to its up position, and when the seat and the shaft are in their respective up positions, rotation of the shaft to the down position pivots the seat to its down position;

the shaft having a key, and the hinge member having a circumferential slot adapted to receive the key, the slot having first and second ends, and the key engaging the first end of the slot when the seat and the shaft are in their respective down positions, so that movement of the seat from its down position to its up position rotates the shaft, and the key engaging the first end of the slot when the seat and shaft are in their up positions, so that movement of the shaft from its up position to its down position causes the seat to pivot to its down position, the key being freely moveable with the slot, so that when the shaft and seat are in their up positions, the seat can be manually moved to its down position;

a spring resiliently biasing the shaft to rotate from the up position to the down position;

a flush detector for detecting when the toilet is flushed; and a lock for releasably locking the shaft against rotation, but which releases the shaft after the flush detector detects that the toilet has been flushed.

2. The hinge assembly according to claim 1 wherein the lock comprises a solenoid having a plunger spring-biased to engage the shaft against rotation when the shaft is in its up position, which when energized disengages the shaft to permit the shaft to rotate under the bias of the spring to its down position, the solenoid being energized when the flush detector detects that the toilet has been flushed.

3. The hinge assembly according to claim 2 wherein the plunger engages the end of the shaft, and wherein ends of the plunger and the shaft are configured to allow relative rotation as the shaft rotates from its down position to its up position, but which prevents relative rotation of the shaft from its up position to its down position until the solenoid is activated to disengage the plunger from the end of the shaft.

4. The hinge assembly according to claim 1 wherein there is a second spring which resiliently biases the toilet seat upwardly, to slow the movement of the seat from the up position to the down position.

5. The hinge assembly according to claim 1 wherein the assembly is adapted for use in a tank-type toilet, and the flush detector includes a sensor for sensing the drop in the water level in the tank that occurs when the toilet is flushed.

6. The hinge assembly according to claim 1 further comprising a second hinge member adapted for attachment to the seat, and pivotally mounted for movement between an up position and a down position to allow the seat to pivot between an up position and a down position, and a spring which resiliently biases the second hinge member to the up position to slow the movement of the seat from the up position to the down position.

7. The hinge assembly according to claim 1 wherein further comprising a battery powering the hinge assembly and a switch for disconnecting the battery when the seat is not in its up position.

8. A hinge assembly for installation on a toilet to mount a toilet seat on a toilet for pivotal movement between an up position and a down position, and to automatically move the seat from the up position to the down position after the toilet is flushed assembly comprising:

a shaft mounted for rotation about its axis between an up position, and a down position;

a hinge member for attachment to the toilet seat, mounted on the shaft so that when the seat and the shaft are in their respective down positions, movement of the seat to the up position rotates the shaft to its up position, and when the seat and the shaft are in their up positions, rotation of the shaft to the down position pivots the seat to its down position;

the shaft having a key, and the hinge member having a circumferential slot adapted to receive the key, the slot having first and second ends, the key engaging the first end of the slot when the seat and the shaft are in their respective down positions, so that movement of the seat from the down position to the up position rotates the shaft, and the key engaging the first end of the keyway when the seat and shaft are in their respective up positions, so that movement of the shaft from its up position to its down position causes the seat to pivot to its down position, the key being freely slidable within the slot, so that when the shaft and seat are in their up positions, the seat can be manually moved to its down position;

a spring resiliently biasing the shaft to rotate from the up position to the down position;

a solenoid having a plunger spring biased to engage the shaft against rotation when it is in the up position, which when energized disengages the shaft to permit the shaft to rotate under the bias of the spring to its down position; and a flush detector for detecting when the toilet is flushed, and energizing the solenoid when a flush is detected.

9. The hinge assembly according to claim 8 wherein there is a second spring which resiliently biases the toilet seat upwardly, to slow the movement of the seat from the up position to the down position.

10. The hinge assembly according to claim 8 wherein the assembly is adapted for use in a tank-type toilet, and the flush detector includes a sensor for sensing the drop in the water level in the tank that occurs when the toilet is flushed.

11. The hinge assembly according to claim 8 further comprising a second hinge member adapted for attachment to the seat, and pivotally mounted for movement between an up position and a down position to allow the seat to pivot between an up position and a down position, and a second spring which resiliently biases the second hinge member to the up position, to slow the movement of the seat from the up position to the down position.

12. The hinge assembly according to claim 11 wherein the second hinge member is mounted on a shaft mounted for rotation between an up and a down position, and wherein the second spring urges the shaft from its down to its up position to slow the movement of the seat from its up to its down position.

13. The hinge assembly according to claim 8 wherein the plunger engages the end of the shaft, and wherein ends of the plunger and the shaft are configured to allow relative rotation as the shaft rotate from its down position to its up position, but which prevents relative rotation of the shaft from it up position to its down position until the solenoid plunger activated to disengage the plunger from the end of the shaft.

* * * * *